US010961070B2

(12) United States Patent
Yu Chen

(10) Patent No.: US 10,961,070 B2
(45) Date of Patent: Mar. 30, 2021

(54) PAPER ROLL DISPENSER

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 336 days.

(21) Appl. No.: 16/257,015

(22) Filed: Jan. 24, 2019

(65) Prior Publication Data

US 2020/0239258 A1 Jul. 30, 2020

(51) Int. Cl.
*B65H 16/00* (2006.01)
*B65H 16/06* (2006.01)
*B65H 16/02* (2006.01)

(52) U.S. Cl.
CPC ..... *B65H 16/005* (2013.01); *B65H 16/023* (2013.01); *B65H 16/06* (2013.01)

(58) Field of Classification Search
CPC .... B65H 16/005; B65H 16/023; B65H 16/06; B65H 35/10; B65H 23/08; B65H 20/02
See application file for complete search history.

(56) References Cited

U.S. PATENT DOCUMENTS 1,433,148 A * 10/1922 Parsons ..... B31F 1/0009 493/357
1,652,417 A * 12/1927 Shaffer ..... B65H 45/12 493/360
3,826,443 A * 7/1974 Goodley ..... B65H 49/18 242/421.9
3,899,143 A * 8/1975 Slezak ..... B65H 59/04 242/156.2
4,454,974 A * 6/1984 Cooke ..... A47K 10/40 225/106
8,490,366 B1 * 7/2013 Hintz ..... A01F 15/0715 53/64
9,315,352 B2 * 4/2016 Nelson ..... B65H 23/08
2012/0138234 A1 * 6/2012 Yu Chen ..... B65H 35/0033 156/510
2016/0340070 A1 * 11/2016 Yu Chen ..... B65H 16/005

* cited by examiner

*Primary Examiner* — Michael E Gallion

(74) *Attorney, Agent, or Firm* — Bruce Stone LLP; Joseph A. Bruce

(57) ABSTRACT

A paper roll dispenser can be installed with a paper roll, which is parallel to a long press plate, which has an upper side connected with a hold-down strip. When the paper of the paper roll contact with the hold-down strip, the paper exceeds the paper roll can produce cutting effect. A guide roller is provided beneath the paper roll and if change the direction of the paper roll, the paper of the paper roll can be connected to a crumpled paper device by means of the guide roller, able to produce an effect of constriction of the paper, thus tallying with demand of ergonomics.

8 Claims, 5 Drawing Sheets

PAPER ROLL DISPENSER

BACKGROUND OF THE INVENTION

1. Field of the Invention

This invention relates to a dispenser, particularly to a paper roll dispenser.

2. Description of the Prior Art

Since digital automation and computer printers spring up in offices; therefore, use of paper becomes wider and wider and thus bringing people much convenience, such as information paper and packaging paper, and in use of the packaging paper, crumpled paper is used most extensively, but the process of producing crumpled paper needs a certain manpower and consumes much time. Therefore, a "CRUMPLED PAPER MACHINE" is disclosed in an U.S. Pat. No. 9,315,352. This device is able to have the paper roll pushing forward along a guide roller and a brake arm rolling wheel direction and extending to a funnel type passage and then, the paper guided in the passage will be compressed to produce creases by making use of the limited space, thus able to save manpower and time and further solve the problem of how to constrict and collect the paper efficiently.

However, the conventional crumpled paper machine has only a function of constriction of paper. When the paper needs cutting or being cut apart, extra cutting tools like scissors or art knives are necessary to be used, likely to be dangerous in use. Further, that the paper roll, the guide roller and the brake arm rolling wheel are provided at a same side will probably produce interference and impossible to operate smoothly.

In view of foresaid drawbacks, the inventor of this invention thinks that the conventional crumpled paper machine is complicated in structure and apt to cause trouble and needs to be ameliorated and hence devises this invention.

SUMMARY OF THE INVENTION

The objective of this invention is to offer a paper roll dispenser, which is able to produce a technique of two different functions: cutting paper and producing crumpled paper by adjusting the provided direction of the paper roll, fluent and convenient in use.

The paper roll dispenser in the present invention includes a base provided with a foundation frame, which has two sides respectively provided with an erect frame. A carrying deice is formed with two position-limiting members fixed with the erect frame, and the position-limiting members installed with a shaft lever therebetween. A press plate has two ends respectively provided with an interactive member pivotally connected with the erect frame, and the interactive member is connected with an elastic member, which has another end connected with the erect frame. A guide device is provided with a support rod connected with the erect frame, the guide device being parallel to the shaft lever. A crumpled paper device is fixed with the foundation frame and provided with a cutting member.

The paper roll dispenser of this invention is by changing the provided direction of the paper roll and by making use of the press plate and the crumpled paper device to produce a technique of two different functions: cutting of paper and constriction of paper, fluent and convenient in use.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
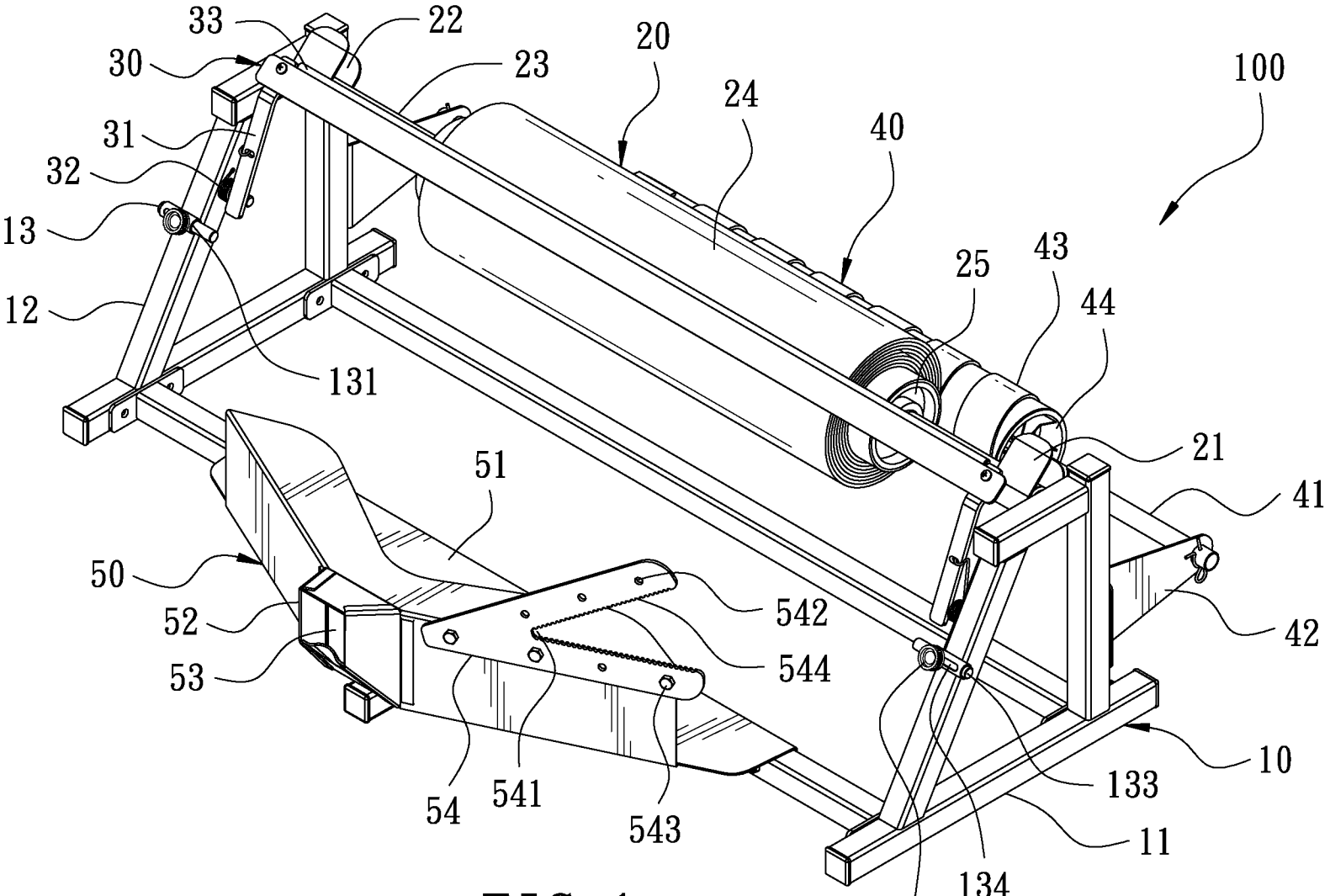
FIG. 1 is a perspective view of a paper roller dispenser in the present invention.
Figure 2:
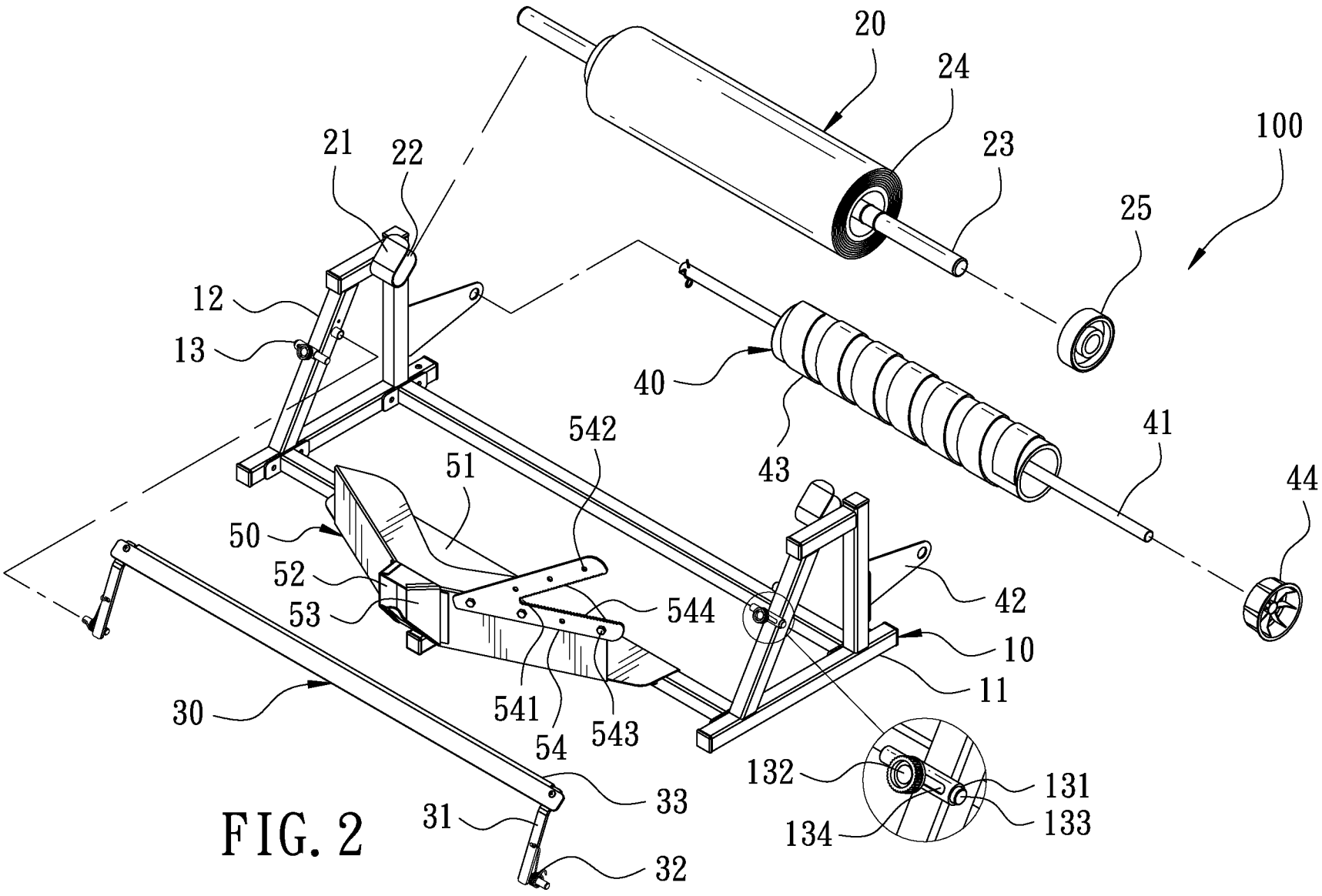
FIG. 2 is a partial exploded perspective view of the paper roller dispenser in the present invention.

A preferred embodiment of a paper roll dispenser 100 in the present invention, as shown in FIGS. 1 and 2, includes a base 10, a carrying device 20, a press plate 30, a guide device 40 and a crumpled paper device 50 as main components combined together.

The base 10 is provided with a foundation frame 11 having two sides respectively provided with an erect frame 12 respectively having an engage element 13, which is formed with a receiving portion 131, a switch button 132 and an insert pin 133. The receiving portion 131 is a hollow cylinder and has one side wall bored with an adjusting hole 134. The insert pin 133 is received in the receiving portion 131, and the switch button 132 is a rotating screw whose thread section is inserted through the adjusting hole 134 and threadably fixed with the insert pin 133 so that the insert pin 133 is able to shift along the receiving portion 131 to form a first position and a second position.

The carrying device 20 is formed with two position-limiting members 21, which are oblique U-shaped grooves 22 and fixed with the erect frame 12. Further, the position-limiting members 21 can be assembled therebetween with a shaft lever 23 for series connecting a paper roll 24 made of kraft. The shaft lever has at two ends of the paper roll 24 respectively connected with a stop member 25, which are inserted through the shaft lever 23 for stopping the paper roll 24 from sliding.

The press plate 30 is positioned at a first side of the carrying device 20 and has two ends respectively provided with an interactive member 31, which is pivotally connected with the erect frame 12 and connected with an elastic member 32, which has another end connected with the erect frame 12. Further, the press plate 30 is connected with a hold-down strip 33 parallel to the press plate 30.

The guide device 40 is positioned at a second side of the carrying device 20 and provided with a support rod 41 connected with the erect frame 12 and parallel to the shaft lever 23. The support rod 41 has two ends respectively connected with a stationary member 42 that is a stationary plate, and the stationary member 42 has another end firmly secured with the erect frame 12. Further, the support rod 41 is mounted thereon with a rolling wheel 43, which has two sides respectively fixed with a positioning member 44 inserted through the support rod 41.

The crumpled paper device 50 is located at the first side of the carrying device 20 and combined with the foundation frame 11. The crumpled paper device 50 is funnel-shaped and formed with an intake 51 and an outlet 52, and a funnel type passage 53 is formed between the intake 51 and the outlet 52. The crumpled paper device is provided with a cutting member 54 beside the outlet 52, and the cutting member 54 is V-shaped and provided with an opening 541 whose two sides are respectively bored with a plurality of threaded holes 542. Further, one side of the opening 541 has the cutting member 54 firmly connected with the crumpled paper device 50 by means of plural bolts 543, and the opening 541 has two sides respectively disposed with a blade 544, which is serrated or wave shaped.

Figure 3:
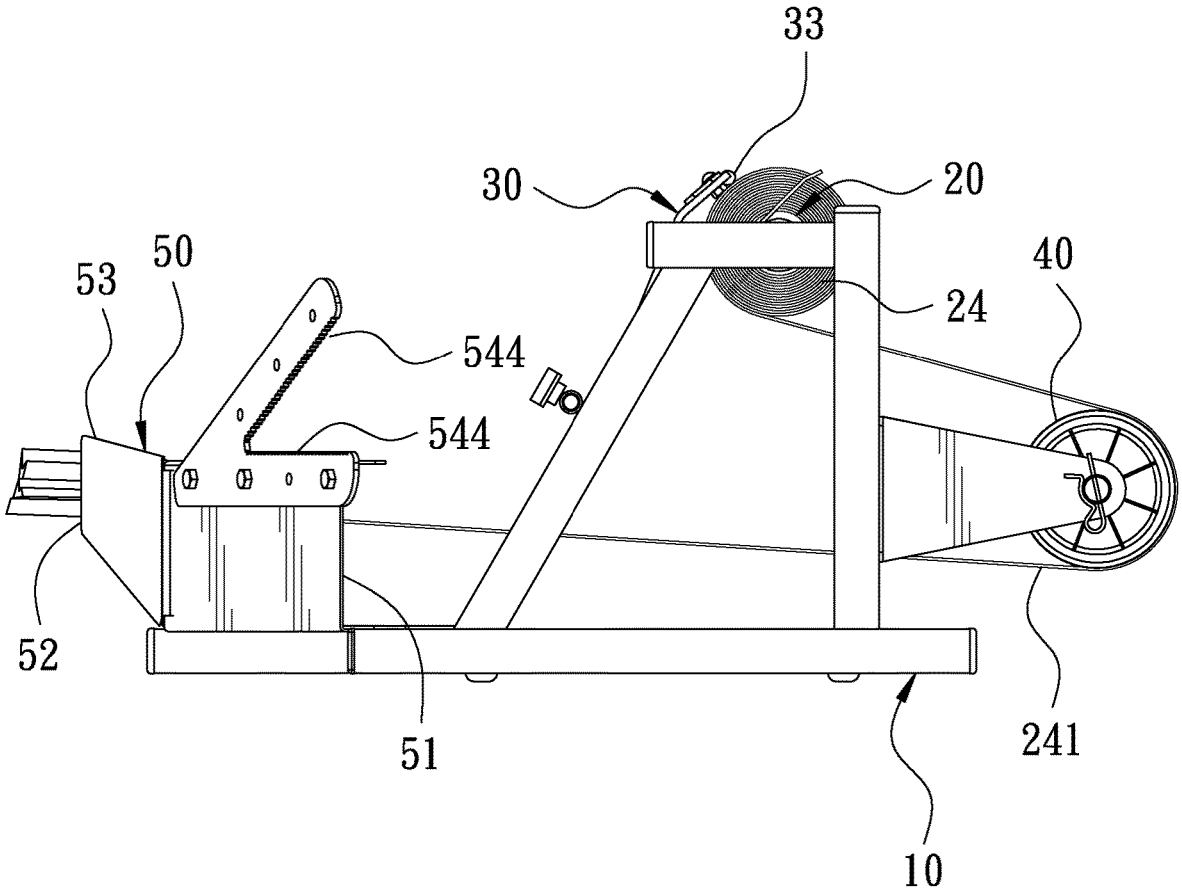
FIG. 3 is a schematic view of the paper roller dispenser in the present invention, showing a state that the paper roll dispenser is used for constriction of the paper roll.

Referring to FIGS. 2 and 3, which show a state of using the paper roll dispenser 100 to constrict the paper roll. To operate the paper roll dispenser 100, a user is first to have the paper roll 24 tandem connected with the shaft lever 23 and have the two stop members 25 respectively fitted at the two ends of the paper roll 24 for fixing the paper roll around the intermediate portion of the shaft lever 23. Next, the shaft lever 23 is respectively positioned on the position-limiting members 21 and, by the elastic force of the elastic member 32 of the press plate 30, the press plate 30 can press against and fix the paper roll in position for maintaining the stability of the carrying device 20 not to sway when the carrying device 20 is used. At this time, a user pulls out downward the paper 241 of the paper roll and then have the paper 241 passing by the guide device 40 and then have the paper 241 passing round the guide device 40 and finally the paper 241 of the paper roll 24 is guided to the intake 51 of the crumpled paper device 50. Since the crumpled paper device 50 is provided with the funnel type passage 53; therefore, when the paper 241 of the paper roll 24 passes through the size-reduced funnel type passage 53, the paper 241 of the paper roll 24 will be compressed to produce creases. After the paper 241 of the paper roll 24 passes out of the outlet 52, the crumpled paper 241 can be pulled out and cut by blade 544.

Referring to FIGS. 1 and 3, in this invention, the crumpled paper device 50 is positioned at a first side of the carrying device 20, while the guide device 40 is positioned at a second side of the carrying device 20; therefore, the paper 241 will first pass round the guide device 40 at the second side of the carrying device 20, and then guided to the crumpled paper device 50 at the first side of the carrying device 20. By so designing, in the process a user pulls out the paper 241, a tension will produce to enable the process of producing crumpled paper to be more direct and more effective, able to save lots of labor and quick in production.

Figure 4:
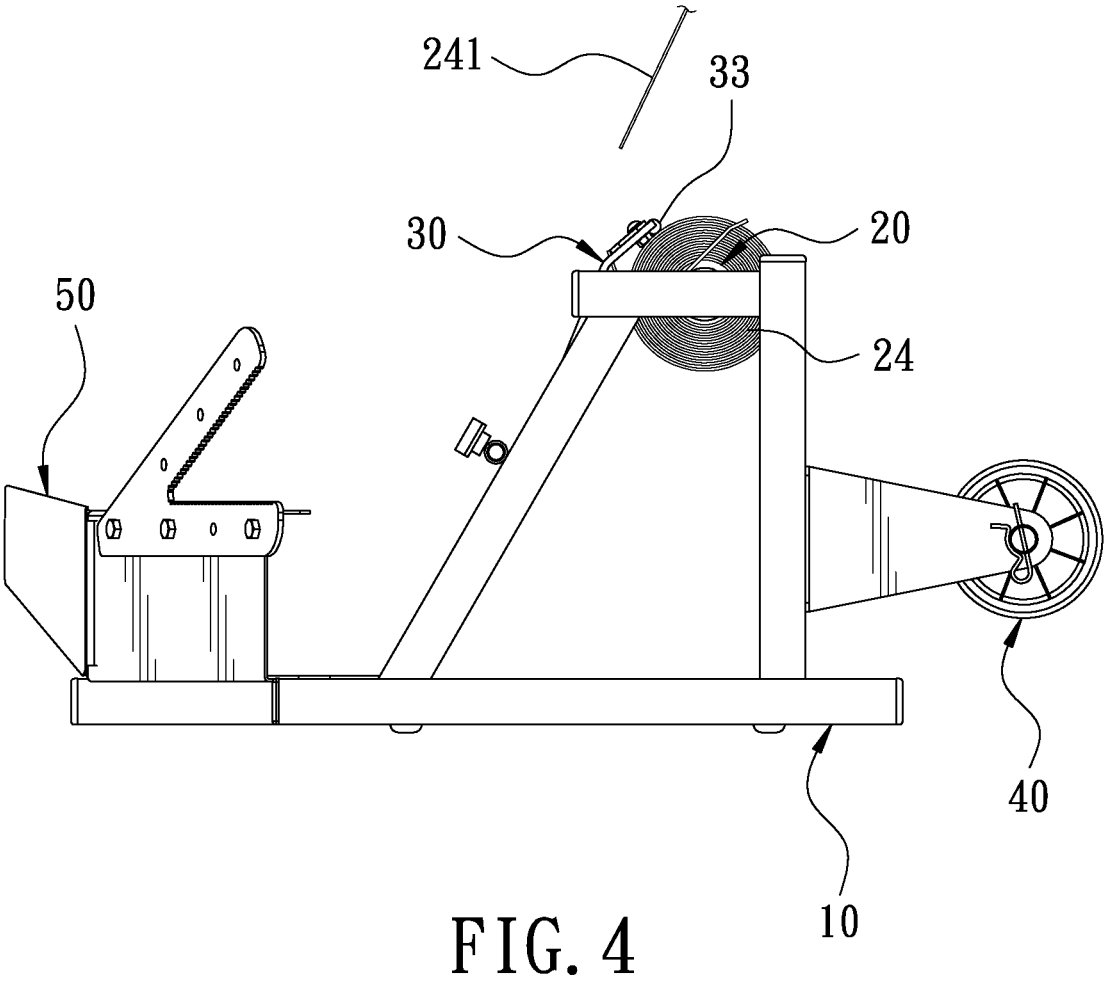
FIG. 4 is a schematic view of the paper roller dispenser in use in the present invention, showing a state that the paper roll dispenser is used for cutting out the paper roll.

Referring to FIGS. 2 and 4, which show a state that the paper roll dispenser cut the paper roll. After the paper 241 of the paper roll 24 is pulled downward, the paper 241 of the paper roll 24 will be moved along the underside of the press plate 30 to have the press plate 30 pressing against and fixing the paper roll 24 by elastic force of the elastic member 32 of the press plate 30, thus able to maintain the stability of the carrying device 20 not to sway when the carrying device 20 is used. Lastly, the paper 241 of the paper toll 24 can be separated by separating the hold-down strip 33 from the paper roll 24, thus achieving the purpose of cutting apart the paper 241.

Figure 5:
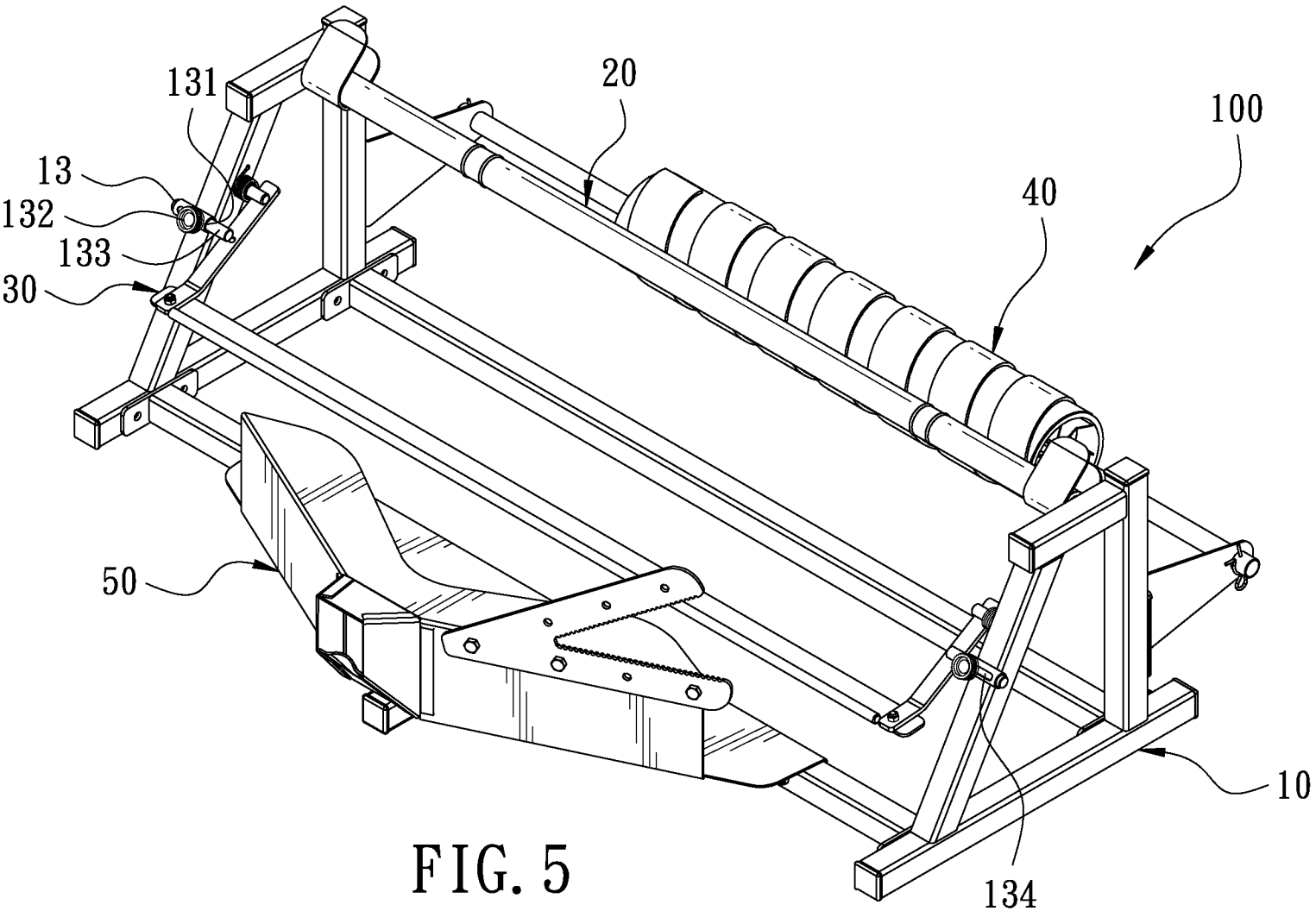
FIG. 5 is a schematic view of the paper roller dispenser in use in the present invention, showing a state that the paper roll dispenser is used for cutting apart the paper roll.

Referring to FIG. 5, what is worth mentioning is that the direction of the paper roll 24 can be replaced by adjusting the switch button 132 of the engage element 13. If the switch button 132 is moved left, the insert pin 133 can be shifted to the first position along the receiving portion 131 and thus loosen the press plate 30 for facilitating replacing the paper toll 24. On the contrary, if the switch button 132 is moved right, the insert pin 133 will be shifted to the second position along the receiving portion 131 and at this time, the press plate 30 will rest against the carrying device 20 and restrict the paper roll 24 from moving.

While the preferred embodiment of the invention has been described above, it will be recognized and understood that various modifications may be made therein and the appended claims are intended to cover all such modifications that may fall within the spirit and scope of the invention.

What is claimed is:

1. A paper roll dispenser comprising:

a base provided with an foundation frame, said foundation frame having two sides respectively provided with an erect frame;

a carrying device formed with two position-limiting members, said two position-limiting members fixed with said erect frame, said position-limiting member installed with a shaft lever therebetween;

a press plate having two ends respectively provided with a interactive member, said interactive members pivotally connected with said erect frame, said interactive members respectively connected with an elastic member, said elastic member having another end connected with said erect frame;

a guide device provided with a support rod. Said support rod connected with said erect frame, said guide device parallel to said shaft lever; and a crumpled paper device combined with said foundation frame, said crumpled paper device provided with a cutting member.

2. The paper roll dispenser as claimed in claim 1, wherein said support rod having two ends respectively connected with a stationary member, said stationary member having another end fixedly connected with said erect frame.

3. The paper roll dispenser as claimed in claim 1, wherein said cutting member is V-shaped, said cutting member having an opening, said opening having two sides respectively disposed with a blade.

4. The paper roll dispenser as claimed in claim 1, wherein said crumpled paper device is funnel-shaped.

5. The paper roll dispenser as claimed in claim 1, wherein said press plate is connected with a hold-down strip, said hold-down strip parallel to said press plate.

6. The paper roll dispenser as claimed in claim 1, wherein said support rod is mounted thereon with a rolling wheel, said rolling wheel having two sides respectively provided with a positioning member, said positioning member inserted through said support rod.

7. The paper roll dispenser as claimed in claim 1, wherein said erect frame has two sides respectively provided with an engage element, said engage element formed with a receiving portion , a switch button and an insert pin, said receiving portion being a hollow cylinder, said receiving portion having a side wall bored with an opening, said insert pin positioned in said in receiving portion, said switch button being rotating screw, said rotating screw having a thread portion inserted through said opening and threadably fixed with said insert pin, said insert pin able to be shifted along the receiving portion and form a first position and a second position.

8. The paper roll dispenser as claimed in claim 1, wherein said crumpled paper device is located at a first side of said carrying device, and said guide device is located at a second side of said carrying device.

* * * * *